United States Patent [19]

Sugisaku et al.

[11] Patent Number: 4,664,621

[45] Date of Patent: May 12, 1987

[54] GAS CUTTING TORCH

[75] Inventors: Noritsugu Sugisaku; Tetsuya Iizuka, both of Tokyo, Japan

[73] Assignee: Koike Sanso Kogyo Co. Ltd., Tokyo, Japan

[21] Appl. No.: 845,992

[22] Filed: Mar. 31, 1986

[51] Int. Cl.[4] ..... F23D 14/82

[52] U.S. Cl. ..... 431/346; 431/354

[58] Field of Search ..... 431/354, 346; 239/433, 239/434.5; 48/180.1

[56] References Cited

U.S. PATENT DOCUMENTS 2,213,043 8/1940 Jacobsson et al. ..... 431/346

*Primary Examiner*—Carroll B. Dority, Jr.

*Attorney, Agent, or Firm*—Basile Weintraub Hanlon

[57] ABSTRACT

The present invention relates to a gas cutting torch characterized in that a buffer is included within the preheating oxygen-supplying passage which is arranged in the inside of the injector head capable of supplying the preheated oxygen.

10 Claims, 5 Drawing Figures

FIG.1
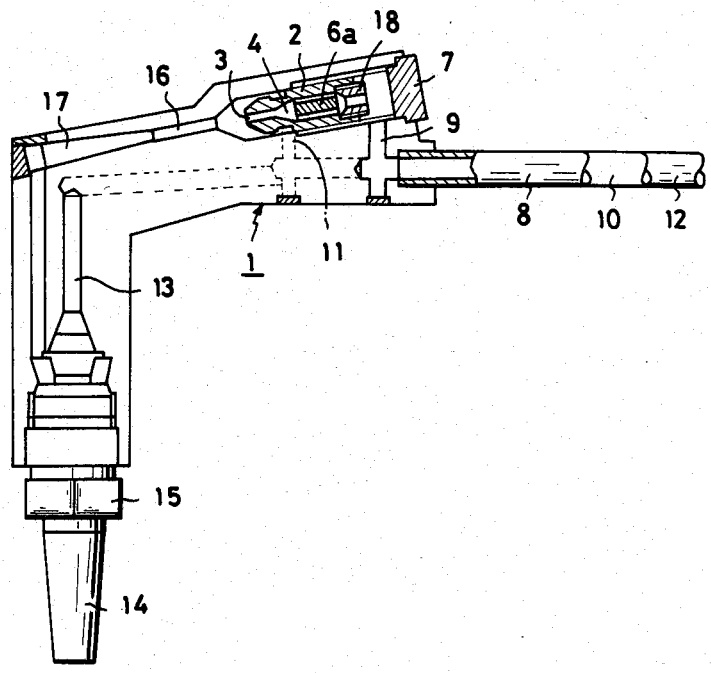
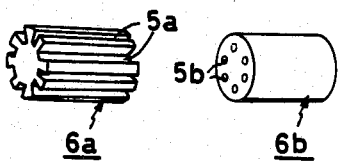
FIG.2(A) FIG.2(B)

GAS CUTTING TORCH

BACKGROUND OF THE INVENTION

1. Field of the Invention

The present invention relates to a cutting torch for gas cutting steel materials, more particularly it relates to a gas cutting torch that is constructed to prevent a backfire-phenomenon from breaking out continuously within the cutting torch which, otherwise, occurs during the cutting operation.

2. Description of the Prior Art

Hitherto, when a nozzle for gas cutting was pressed against a steel plate in the process of gas cutting, a spatter could be generated during cutting and would sometimes adhere to the nozzle, causing a backfire-phenomenon to be generated continuously within the cutting torch.

Therefore, and as shown in FIG. 4 hereof, a prior art method for absorbing the fuel gas by emitting high speed oxygen from the injector hole 3 of the injector head 2 in the gas cutting torch to prevent this backfire-phenomenon from being generated continuously has heretofore been proposed. Likewise, an article constituted by combining the measures of every part in the mixing parts of oxygen and gas with a fixed rate and the like has been disclosed.

However, since no consideration was given to the continuous backfire-phenomenon which was burning continuously in the gas mixing portion of the prior art, it was difficult to prevent the backfire-phenomenon.

Further, the prior art was effective where there was little discharge of the mixed gas, but there were defects in that the effectiveness was non-existent in the case of increased discharge and the like. Also, the techniques described in the specifications of U.S. Pat. No. 4,248,384 and No. 4,477,262 were well known, but it was difficult to prevent the continuous occurrence of the backfire in these techniques.

SUMMARY OF THE INVENTION

The present invention provides a gas cutting torch that is able to prevent the backfire phenomenon from being generated continuously within the gas cutting torch.

The present invention comprises a gas cutting torch which prevents the continuous backfire phenomenon. The cutting torch hereof includes a buffer within the preheating oxygen-supplying passage of the injector head of the torch to reduce fluid flow into an enlarged passage. The buffer can comprise a gear type-column having a plurality of grooves in the axial direction of an external circumferential surface or a lotus root type-column having a plurality of passing holes in the axial direction of the interior.

BRIEF DESCRIPTION OF THE DRAWING

In the drawing like reference numeral refers to like parts throughout the several views in which;

FIG. 1 is a sectional view showing the parts of the gas cutting torch in accordance with the present invention.

FIG. 2(A) is a perspective view of a first embodiment of the buffer hereof.

FIG. 2(B) is a perspective view of a second embodiment of the buffer utilized in the practice of the present invention.

DETAILED DESCRIPTION OF THE PREFERRED EMBODIMENT

Figure 4:
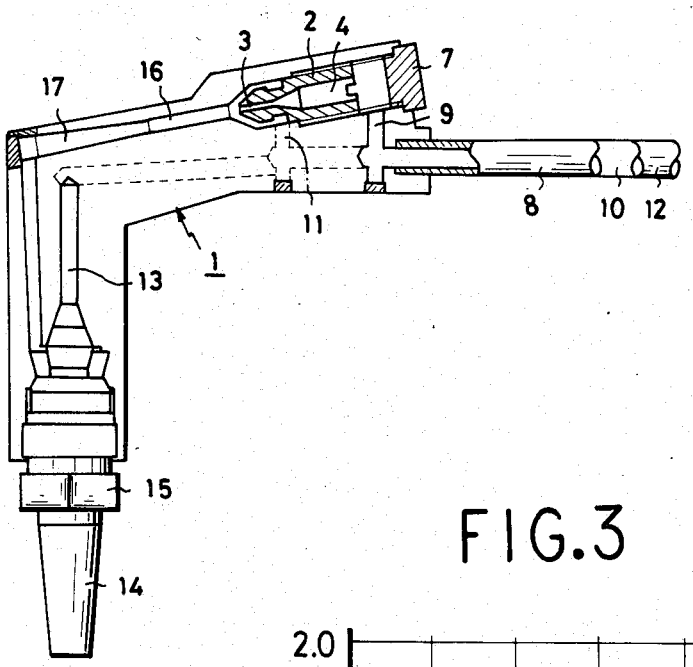
FIG.4 PRIOR ART
FIG. 4 is a sectional view showing an example of a prior art gas cutting torch.

Referring now to an embodiment in accordance with the present invention shown in FIG. 1 and FIG. 2(A), there is provided a gas cutting torch 1, including an injector head 2 having an injector aperture 3 disposed within the interior of the gas cutting torch.

A buffer 6*a* comprising a gear type-column having a plurality of grooves 5*a* formed in the axial direction of the external circumferential surface, is inserted within a preheating oxygen-supplying passage 4 inside the injector head 2. The buffer 6*a* is held in place by a hollow cap screw 18. The injector head 2 is held inside the gas torch by a back cap 7.

As shown in FIG. 2(B) the buffer 6*b* comprises a lotus root type-column. The lotus root type-column has a plurality of holes 5*b* passing in the axial direction within the interior of the column.

As shown in FIG. 1, a pipe 8 supplies the preheated or preheating oxygen. The pipe 8 supplies the preheated oxygen to the injector head 2 through a supplying passage 9. A pipe 10 supplies the fuel gas, around the injector head 2 through a supplying passage 11. A pipe 12 supplies the cutting oxygen. Pipe 10 supplies the cutting oxygen to a nozzle 14 through a passage 13. A nut or similar fastener 15 fixes the nozzle 14 in position by threaded tightening or the like.

The torch 1, also, includes a passage 16 for supplying a mixed gas, wherein the preheated oxygen is mixed with the fuel gas, to the nozzle 14. An enlarged passage 17 is arranged as a part of the mixed gas passage 16.

A hollow cap screw 18 holds the buffer 6*a* or 6*b* within the injector head 2, by installing and screwing the cap screw 18 to the inner circumferential wall of the injector head 2.

As mentioned above, the present invention comprises the provision of the buffer 6*a* or 6*b* within the preheating oxygen-supplying passage 4 of the injector head 2. When the backfire phenomenon is generated by a reversal of fire from the tip of the nozzle 14 to the neighborhood of the enlarged passage 17, an unusual impulsive pressure collides with the buffer 6*a* or 6*b* through the injector hole or aperture 3. At this juncture since a sectional area of a wall surface of a central part of the buffer 6*a* or 6*b* is larger than a sectional area of the injector hole 3, the unusual pressure is dissipated by the buffer 6*a* or 6*b*. At the same time, the preheated oxygen is supplied as usual through the grooves 5*a* of the buffer 6*a* or the holes 5*b* of the buffer 6*b*.

Furthermore, the unusual pressure based on the backfire phenomenon flows backward, entering the inlet of the fuel gas supplying passage 11, to 50–100 mm and the supply of the fuel gas is suspended temporarily by this backward flow.

Therefore, since only the preheated oxygen flows temporarily in the passage 16 for supplying the mixed gas, the fire based on the backfire is extinguished completely, consequently combustion based on the backfire in the enlarged passage 17 is also extinguished.

Figure 3:
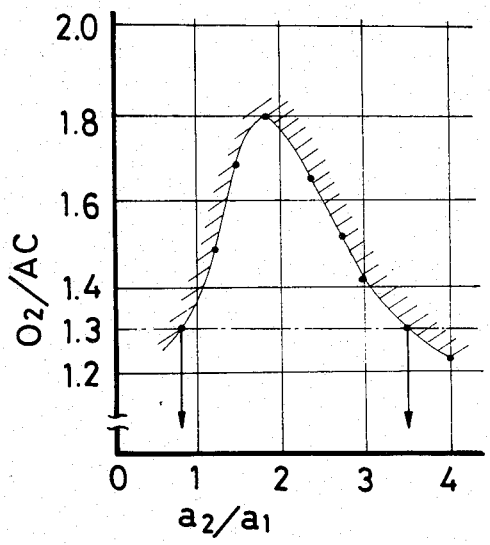
FIG. 3 is a graph showing the backfire-sphere based on the ratio of a sectional area $a_1$ of the injector aperture and an effective sectional area $a_2$ of the passages for preheating oxygen in the buffer.

According to the results of various experiments which were performed by the present inventors, and as shown in FIG. 3 the effective ratio of $a_2$ to $a_1$ for preventing the backfire phenomenon ranges from 0.8 to 3.5, where $a_1$ is the sectional area of the injector hole 3 and $a_2$ is the effective sectional area of the oxygen passages of the buffer 6*a*. The most optimum value of the ratio of $a_2$ to $a_1$ is approximately 1.8. Further, when a diameter of the wall of the central part of the buffer 6*a* is smaller than the inside diameter of the injector hole 3, the effectiveness falls suddenly. Therefore, a diameter of the wall of the central part of the buffer 6*a* larger than the inside diameter of the injector hole 3 is necessary.

The point-chain line indicates a limit of a domain of the customary backfire in FIG. 3, and the range of the upper part of the graphic line is a domain for causing the backfire continuously.

Even if backfires are generated several times during the cutting operations, it is possible to prevent a backfire-phenomenon from continuously burning inside the torch, when the gas cutting torch is constructed in accordance with the present invention.

What is claimed is:

1. A gas cutting torch comprising:

a preheating oxygen supply passage;

an enlarged compartment in communication with the preheating oxygen supply passage;

an injector head disposed within the enlarged compartment having:

an injector aperture, a preheating oxygen-supplying passage in communication with the injector aperture, a buffer disposed within the preheating oxygen-supplying passage, means for holding the buffer within the injector head while permitting preheating oxygen to flow through the means for holding;

means for releasably enclosing the injector head within the enlarged compartment;

a fuel gas supplying passage in communication with the enlarged compartment;

a mixed gas supply passage in communication with the enlarged compartment housing the injector head;

said mixed gas supply passage including an enlarged portion;

a cutting oxygen supply passage;

a nozzle in communication with the cutting oxygen supply passage and the mixed gas supply passage; and means for releasably affixing the nozzle to the gas cutting torch.

2. The gas cutting torch of claim 1, wherein the buffer comprises:

a gear type-column having an exterior circumferential surface with a plurality of axial grooves on the surface.

3. The gas cutting torch of claim 1, wherein the buffer comprises:

a lotus root type-column having a plurality of longitudinal holes passing through the inside of the buffer.

4. The gas cutting torch of claim 1, wherein the buffer comprises:

a plurality of passages having a cumulative cross sectional area 0.8 to 3.4 times greater than a cross sectional area of the injector aperture of the injector head.

5. The gas cutting torch of claim 1 wherein the diameter of the buffer is greater than the diameter of the injector aperture.

6. In a gas cutting torch of the type having an injector head having an injector aperture for delivering preheated oxygen and a preheating oxygen supplying passage within the injector head, the improvement comprising:

a buffer disposed within the preheating-oxygen supplying passage; and means for holding the buffer within the injector head while allowing preheating oxygen to flow through the holding means.

7. The improvement of claim 6, wherein the buffer comprises:

a gear type-column having an exterior circumferential surface with a plurality of longitudinally extending grooves on the surface.

8. The improvement of claim 6, wherein the buffer comprises:

a lotus root type-column having a plurality of longitudinal holes passing through the inside of the buffer.

9. The improvement of claim 6, wherein the buffer comprises:

a plurality of passages having a cumulative cross sectional area 0.8 to 3.4 times greater than a cross sectional area of the injector aperture of the injector head.

10. The improvement of claim 6 wherein the diameter of the buffer is greater than the diameter of the injector aperture.

* * * * *